US007118253B1

(12) United States Patent
Simon

(10) Patent No.: US 7,118,253 B1
(45) Date of Patent: Oct. 10, 2006

(54) EVENLY DISTRIBUTED ILLUMINATION FROM RADIAL LIGHT PRODUCING LUMINAIRES AND THEIR COMPONENTS

(76) Inventor: Jerome H. Simon, 70 Sumner St., Newton Centre, MA (US) 02459

( * ) Notice: Subject to any disclaimer, the term of this patent is extended or adjusted under 35 U.S.C. 154(b) by 212 days.

(21) Appl. No.: 10/151,136

(22) Filed: May 20, 2002

Related U.S. Application Data

(60) Provisional application No. 60/292,117, filed on May 19, 2001.

(51) Int. Cl.
*F21V 5/04* (2006.01)

(52) U.S. Cl. ..... 362/328; 362/290; 362/299; 362/300; 362/301; 362/302; 362/311; 362/346; 362/307; 362/309

(58) Field of Classification Search ..... 362/328, 362/257, 290, 296, 291, 292, 297, 298, 299, 362/300, 301, 302, 311, 346, 307, 308, 309, 362/293, 342, 431, 336, 335; 359/641, 709
See application file for complete search history.

(56) References Cited

U.S. PATENT DOCUMENTS

| | | | | | |
|---|---|---|---|---|---|
| 1,565,973 | A | * | 12/1925 | Sutter | 362/328 |
| 1,900,436 | A | | 3/1933 | Dourgnon | |
| 2,122,295 | A | * | 6/1938 | Rolph et al. | 362/308 |
| 2,344,221 | A | | 3/1944 | Trautner | |
| 2,359,151 | A | | 9/1944 | Pennow | |
| 2,454,332 | A | | 11/1948 | Mitchell et al. | |
| 3,593,014 | A | * | 7/1971 | Vesely | 362/291 |
| 3,646,338 | A | * | 2/1972 | Goytisolo | 362/294 |
| 3,697,740 | A | * | 10/1972 | Breed et al. | 362/257 |
| 3,739,169 | A | | 6/1973 | Weinreich | |
| 3,818,218 | A | * | 6/1974 | Heenan et al. | 362/297 |
| 4,096,555 | A | * | 6/1978 | Lasker | 362/302 |
| 4,159,511 | A | | 6/1979 | Dejonc | |
| 4,264,948 | A | | 4/1981 | Cherouge | |
| 4,452,509 | A | * | 6/1984 | VanBreemen | 359/457 |
| 4,823,246 | A | * | 4/1989 | Dilouya | 362/328 |
| 4,962,450 | A | | 10/1990 | Reshetin | |
| 4,969,074 | A | | 11/1990 | Davis et al. | |
| 5,879,070 | A | * | 3/1999 | Severloh | 362/125 |
| 5,897,201 | A | | 4/1999 | Simon | |

(Continued)

OTHER PUBLICATIONS

Merriam-Webster's Collegiate Dictionary, Tenth Edition, p. 86.*

*Primary Examiner*—Sharon Payne
(74) *Attorney, Agent, or Firm*—Burns & Levinson LLP; Harvey Kaye; Jerry Cohen

(57) ABSTRACT

A lighting assembly includes a quasi-point lamp, a ring lens at least partially surrounding the source to provide a radial beam of light shaped in the form of a disk of sectionally diverging light, and at least one refracting ring to redirect and/or change the beam divergence, and/or at least one reflecting ring to redirect or change the divergence of the beam. A baffle system may be used in conjunction with or in substitution for the refractor or reflector rings to eliminate glare and stray light from the lens or redirect and/or change divergence of the lens. The ring lens surrounding the quasi-point source may be used to divide the illuminating light into radial beams diverging from each other, in which case each radial beam has its own refraction, reflection or baffle assembly. Each radial beam and its attending refraction, reflection and/or baffle assembly is used for specific lighting functions, such as down lighting, ambient lighting, spot or flood lighting and indirect lighting.

28 Claims, 16 Drawing Sheets

U.S. PATENT DOCUMENTS

| | | | |
|---|---|---|---|
| 5,915,823 | A | 6/1999 | Simon |
| 6,027,231 | A | 2/2000 | Fouke |
| 6,354,725 | B1 | 3/2002 | Simon |
| 6,361,191 | B1 | 3/2002 | Simon |
| 6,502,964 | B1 | 1/2003 | Simon |
| 6,536,921 | B1 | 3/2003 | Simon |
| 6,540,382 | B1 | 4/2003 | Simon |
| 6,616,305 | B1 | 9/2003 | Simon |

* cited by examiner

EVENLY DISTRIBUTED ILLUMINATION FROM RADIAL LIGHT PRODUCING LUMINAIRES AND THEIR COMPONENTS

REFERENCE TO RELATED APPLICATIONS

The present application is based on and claims the priority of provisional application Ser. No. 60/292,117 filed May 19, 2001. The substance of that application is hereby incorporated herein by reference.

FIELD OF THE INVENTION

The present invention relates generally to the lighting field and, more particularly, to creating efficiently distributed illumination with low glare and fixture brightness using radially collimated light projection.

BRIEF SUMMARY OF THE INVENTION

It is an object of this invention to create glare-free illumination.

It is another object of this invention to provide broadly distributed light from a central light source.

It is another object of this invention to provide at least two types of light distribution, such as indirect and down lighting, from a single light bulb.

It is another object of this invention to provide illumination patterns on surfaces, such as circles, squares, rectangles and other shapes.

These and other objects of the present invention are accomplished in the following manners, among others:

A luminaire lighting fixture assembly that is surface-mounted on walls or ceilings, suspended from ceilings or mounted on stems to sit on floors or table tops, and contains a quasi-point source lamp surrounded by a ring-shaped collimation lens further surrounded by one or a combination of the following: a refracting disk or ring, a reflecting disk or ring, and a series of baffles or baffle reflectors.

The cross-sectional shape and surface quality of these elements determine the direction, shape, and quality of light that is required for atmosphere and tasks performed in the space in which the luminaires are utilized.

Other objects, features and advantages will be apparent from the following detailed description of preferred embodiments taken in conjunction with the accompanying drawings in which:

DETAILED DESCRIPTION OF THE DRAWINGS

Figure 1:
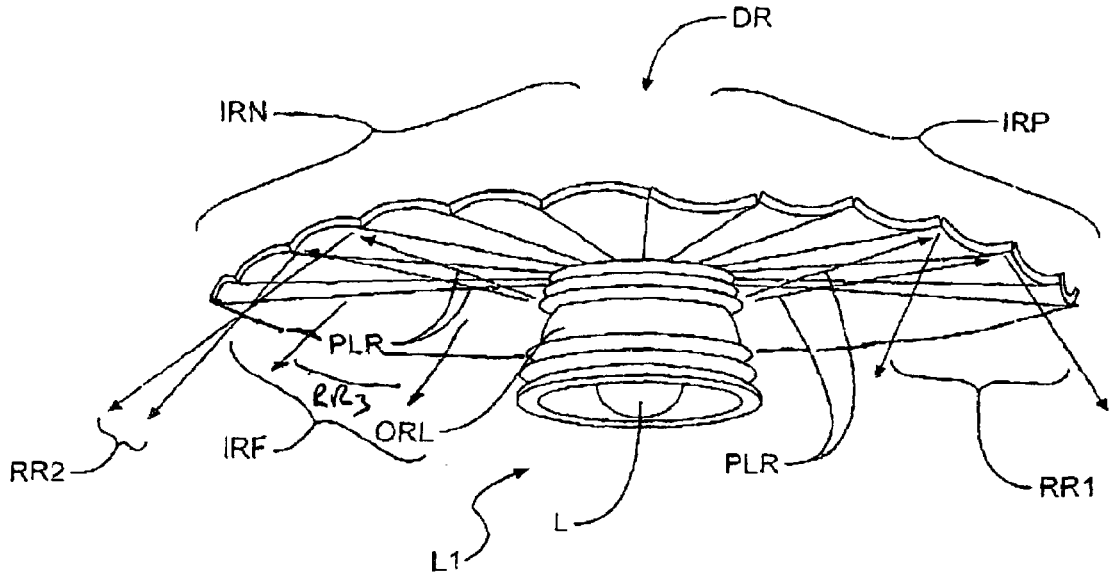
FIG. 1 is an isometric view of a luminaire containing a lamp surrounded by a canted collimating ring lens and a reflecting disk.

FIG. 1 illustrates a luminaire L1 containing a lamp L at the center of an off-axis collimating ring lens ORL which may be spherical or aspheric, solid or Fresnel in section, that projects a ring of canted light rays PLR towards and onto direct reflector disk DR. Canted ring lenses are designed to project collimated rays at predetermined angles away from the central axis of the lamp. For graphic purposes, disk DR is shown to have various pie-shaped sections of different reflective pattern configurations, although direct reflector disk DR may contain a single as well as multiple reflector pattern configurations. Pattern IRN is composed of radially disposed positive flutes that reflect rays PLR as overlapping divergent beam segments RRI. Pattern IRN is composed of radially disposed negative flutes that reflect rays PLR as convergent, then divergent, overlapping beam patterns RR2. Surface IRF is a flat specular or semi-specular reflector that redirects rays PLR as rays RR3 (as illustrated in FIG. 1A).

Figure 1A:
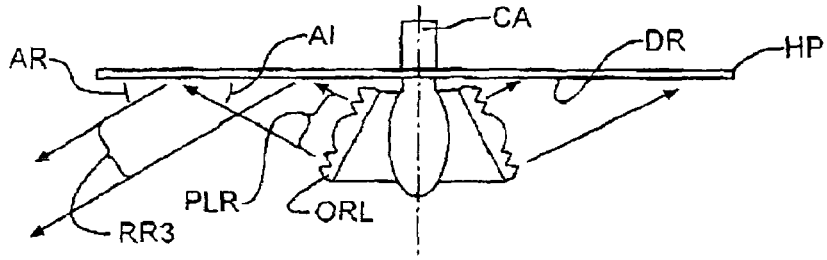
FIG. 1A is a schematic cross-sectional view of FIG. 1.

FIG. 1A shows a graphic cross section of FIG. 1, illustrating disk DR lying on horizontal plane HP, which is perpendicular to optical axis CA. AI shows the incident angle of light from ORL and AR shows the reflected angle of light.

Figure 1B:
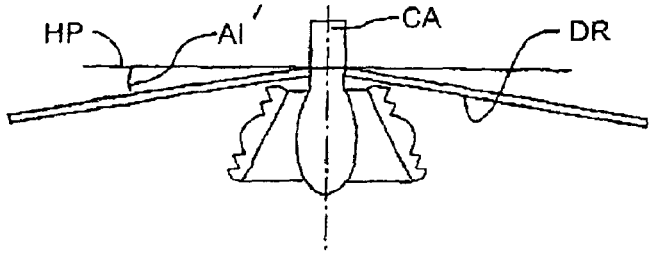
FIG. 1B is a schematic cross-sectional view illustrating a variation of FIG. 1A showing the reflective disk in the shape of a shallow cone.

FIG. 1B illustrates a luminaire configuration in which DR is a cone that is at an acute angle to HP. DR may also lie aspheric or spherical section. Whether the configuration of DR is flat, conical or curved in it may contain various reflector patterns. AI' shows the angle between the horizontal plane HP and disk DR.

Figure 2:
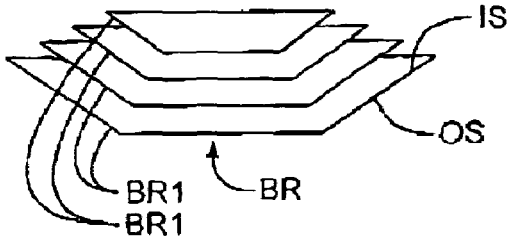
FIG. 2 is a schematic cross-sectional view illustrating a luminaire similar to that in FIG. 1A with the addition of a baffle ring assembly and a diffuser below the lamp.

FIG. 2 illustrates a luminaire similar to that in FIG. 1A with the addition of louver system BR and lower diffuser LD. BR can be a series of light baffles that function to reduce glare by blocking the off-axis collimating ring lens ORL from a direct line of sight (illustrated by arrow LOS), and filtering rays not collimated within a predetermined angle emanating from ORL. LD can be a prismatic diffuser that scatters direct rays LR from the lamp L as rays SR leaving LD.

Figure 2A:
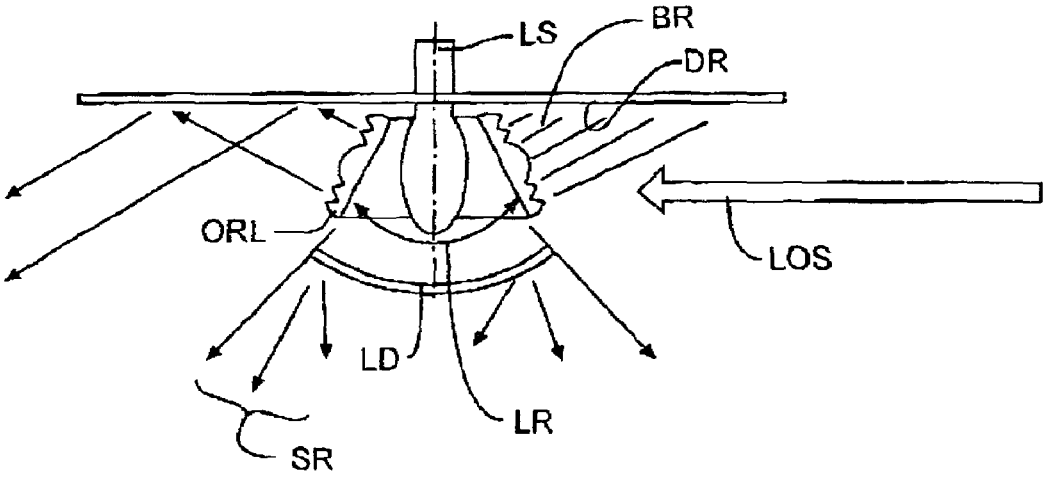
FIG. 2A is an isometric view illustrating the type of baffle assembly that is used in the luminaire shown in FIG. 2.

FIG. 2A illustrates one type of baffle assembly BR comprised of stacked and spaced baffle rings BR1 having black matte surfaces IS and OS. Other types of baffle assemblies are shown in FIGS. 4, 6, 8, and 8A.

Figure 2B:
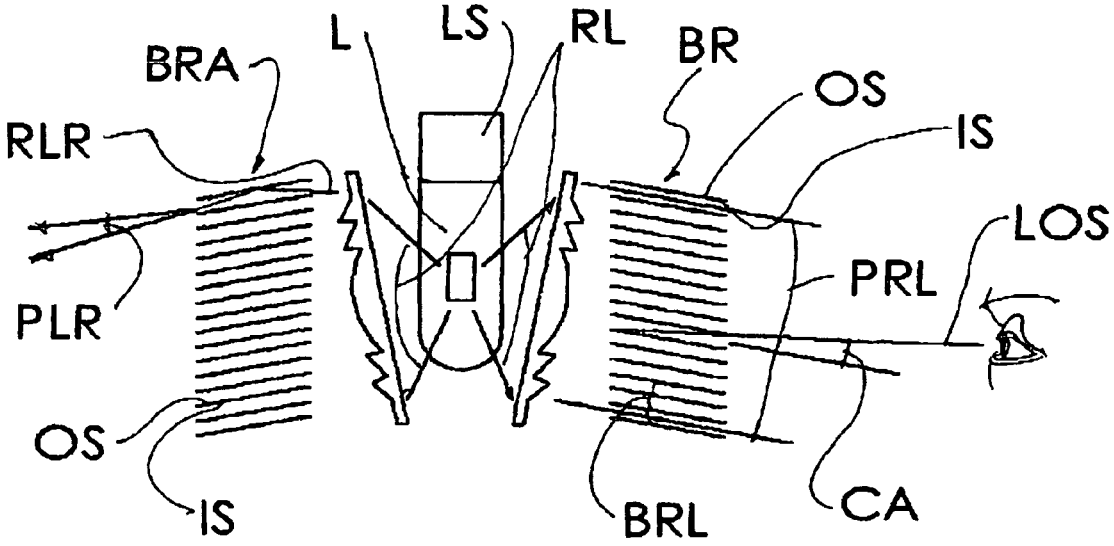
FIG. 2B is a schematic cross-sectional diagram of an optical assembly containing a lamp and an off-axis collimating ring lens surrounded by baffle rings.

FIG. 2B is a typical cross-sectional diagram of an optical assembly that would be used in a luminaire that is designed to provide high efficiency, bright illumination to the far field of the surface to be illuminated while having very low fixture brightness outside the directed beam of the fixture. In FIG. 2B a substantial amount of radiant light RL emanating from lamp L is captured and projected by off-axis collimating ring lens ROL as projected light rays PLR. The F number and size ratio of lens ROL to the arc or filament of lamp L is designed to create the highest degree of collimation and efficiency within the size constraints of the surrounding luminaire. BR is a baffle ring assembly containing individual baffle rings that are canted at the same angle as projected light rays PLR and are fabricated of very thin material so as not to obstruct rays PLR. The distance between individual baffle rings BRL is such that the cutoff angle CA (the angle between rays PLR and the line of sight LOS as seen by eye E) is extremely acute and generally less than ten degrees; thus, the lens ORL and any glare coming from noncollimated light can be seen only within angle CA. On the right side of diagram 2B, both the inner surfaces IS and outer surfaces OS are dull and/or black and non-specular, allowing only light collimated within the angle CA to pass through baffle ring assembly BR. On the left side of the diagram, baffle reflector assembly BRA is constructed of baffle rings BRL that are non-reflective (non-baffling) on the outer surface OS and specular or semi-specular on the inner surface IS, thus reflecting RLR as PLR and lowering and increasing the viewing angle (which is the same as the cutoff angle). The latter descriptions of BR and BRA can be applied to FIGS. 2, 2A, 4, 6, 8, 8A, 14, 15, 16, 17, 18, 19, 19A, 20, 21, 22, 23, 24, 24A, 24B, 24C, 24D, 24E, 25, 26, and any other of the optical configurations that might adopt a baffle system.

Figure 3:
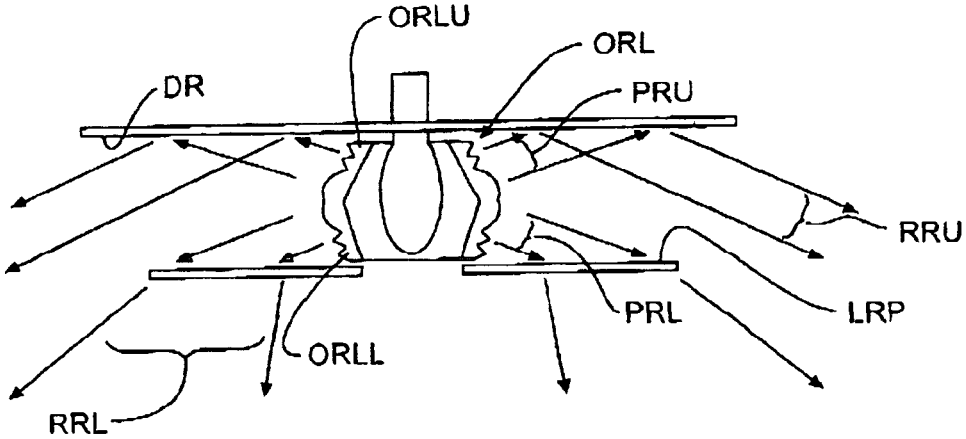
FIG. 3 is a schematic cross-sectional view illustrating a luminaire containing a lamp surrounded by a ring lens comprised of two off-axis ring sections: an upper reflector and a lower diffuser.

FIG. 3 graphically illustrates a luminaire which utilizes a collimating ring lens having two radially off-axis sections, an upper section ORLU and a lower section ORLL. Upper section ORLU projects a ring of canted light rays PRU towards and onto DR, which are reflected as rays RRU. (Further configurations of DR are described in FIGS. 1 and 1B.) Lower section ORLL projects a ring of canted light onto refractor plate RRL, which is redirected as rays RRL.

Figure 4:
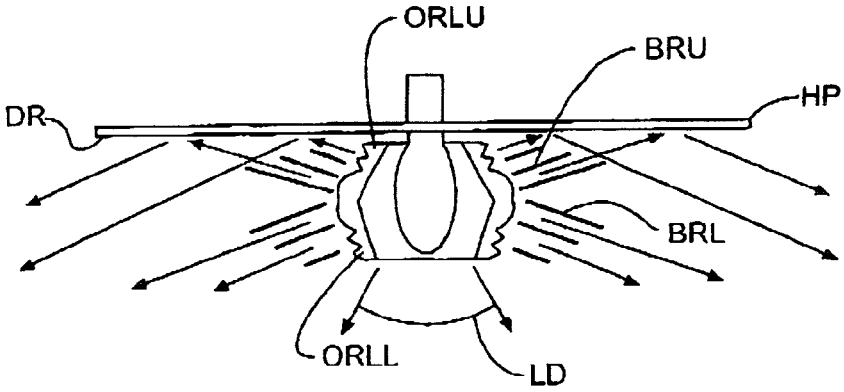
FIG. 4 is a schematic cross-sectional view showing a variation of the luminaire shown in FIG. 3 with the addition of baffle rings surrounding the ring sections and the omission of the lower refractor.

FIG. 4 is a variation of FIG. 3 showing light baffle assemblies as described in FIGS. 2 and 2B, with BRU surrounding ORLU and PRL surrounding ORLL.

Figure 5:
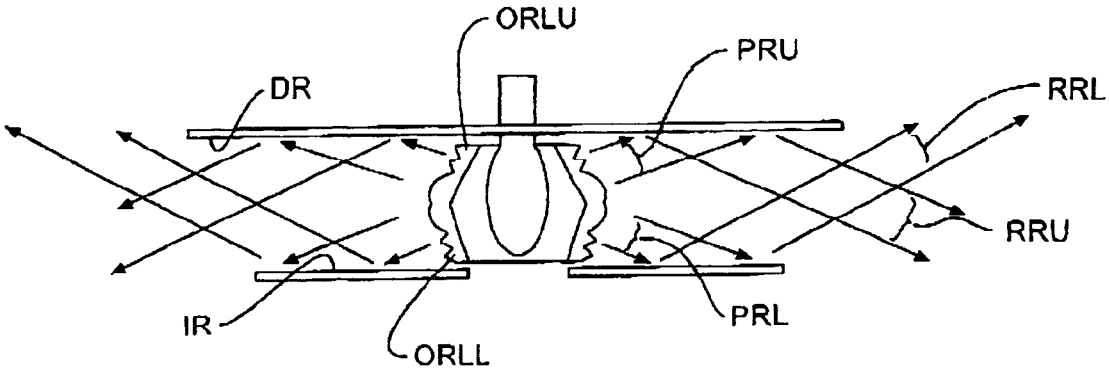
FIG. 5 is a schematic cross-sectional view showing a variation of the luminaire shown in FIG. 3, with the lower refractor being reflected by a reflector.

FIG. 5 is a variation of FIG. 3 with lower refractor plate PRL (FIG. 3) being replaced by indirect reflector IR. Projected rays PRU emanating from ORLU are reflected downward by DR as rays RRU, and rays PRL emanating from ORLU are reflected upward by IR as rays RRL. The luminaire structure in FIG. 5 can have upper or lower baffles as in FIG. 4.

Figure 6:
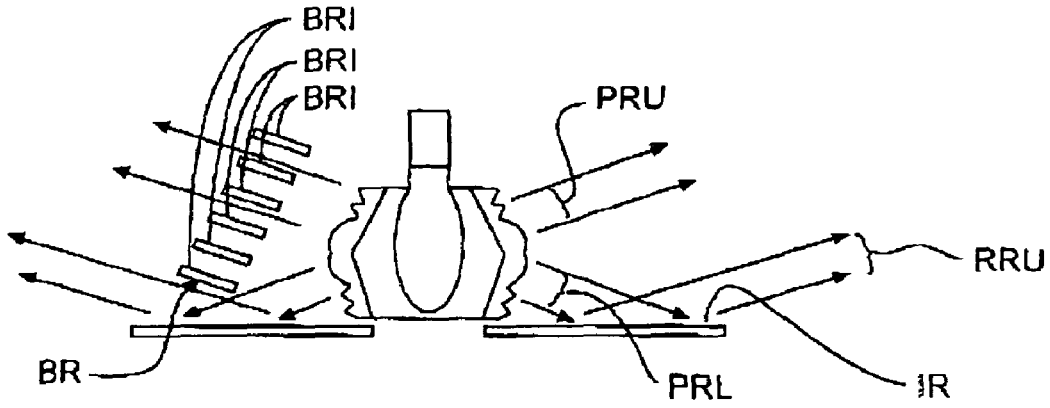
FIG. 6 is a schematic cross-sectional view showing a variation of the luminaire shown in FIG. 5, with the upper reflector removed and the baffle rings added.

FIG. 6 varies from FIG. 5 in that the luminaire's structure in FIG. 6 does not contain direct reflector disk DR (FIG. 5) which allows rays PRU to be unobstructed and rays PRL to be reflected as rays RRU in substantially the same direction as the rays PRU. Baffle assembly BR is shown on the left side of the illustration as an option, having all louvers BRI at substantially the same angle to each other and to rays PRU and RRU.

Figure 7:
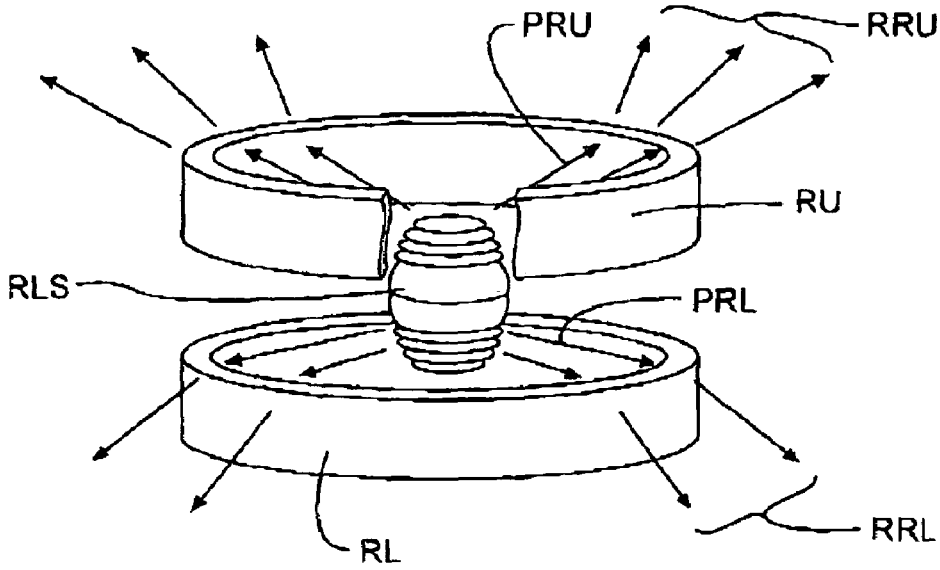
FIG. 7 is an isometric view of a luminaire containing a ring collimator divided into two off-axis sections and an upper and lower refractor.

FIG. 7 illustrates a luminaire having a ring lens assembly RLS (similar to ORLU and ORLL of FIGS. 3 through 6) that projects a ring of canted light rays PRU toward refractor ring RU and a ring of canted light rays PRL toward and onto refractor ring RL. Rays PRU are refracted into a predetermined pattern by RL as rays RRL. DR of FIGS. 1, 1A, 1B, 2, 3, 4, and 5, IR of FIGS. 4, 5, and 6, LRP of FIG. 3, and RU or RL of FIG. 7 are interchangeable for varied luminaire configurations, and may or may not be used in conjunction with baffle ring assemblies such as BR of FIG. 2 or BRU and BRL of FIG. 4.

Figure 8:
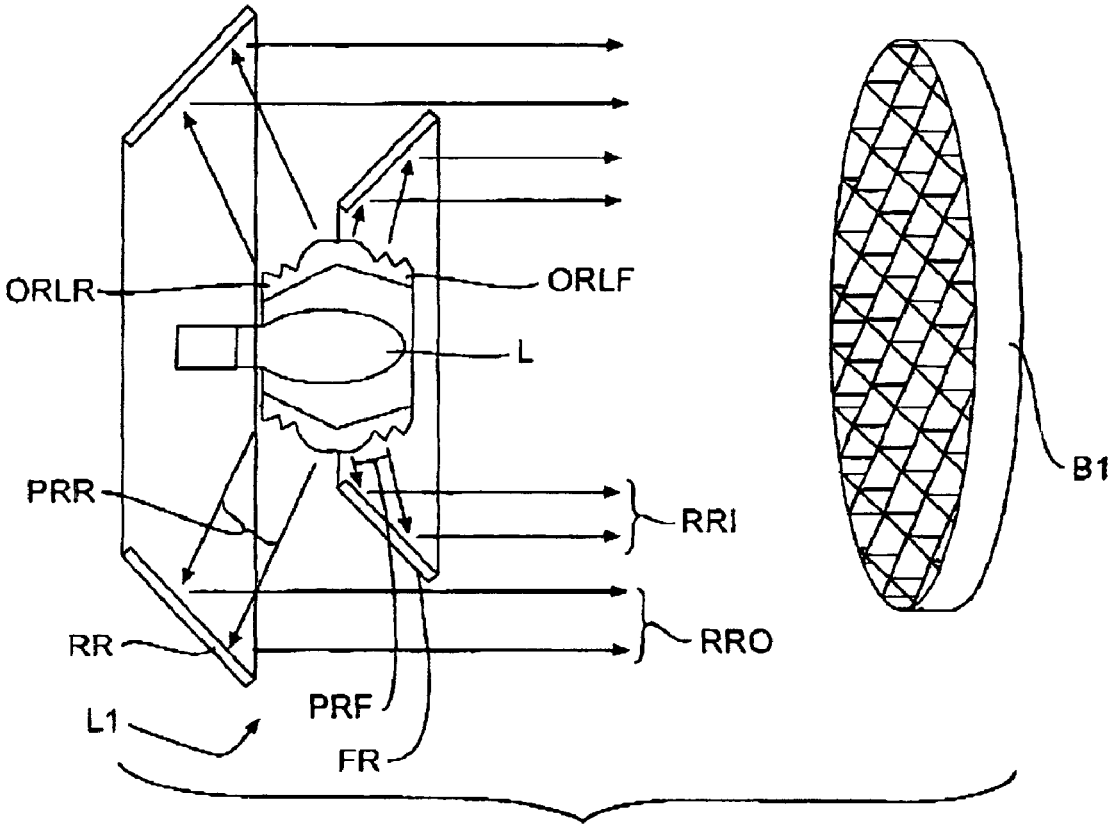
FIGS. 8 and 8A are schematic side views illustrating luminaires containing a lamp surrounded by a ring collimator divided into two off-axis sections further surrounded by reflector rings and a baffle assembly in the path of the rays from the reflectors.
Figure 8A:
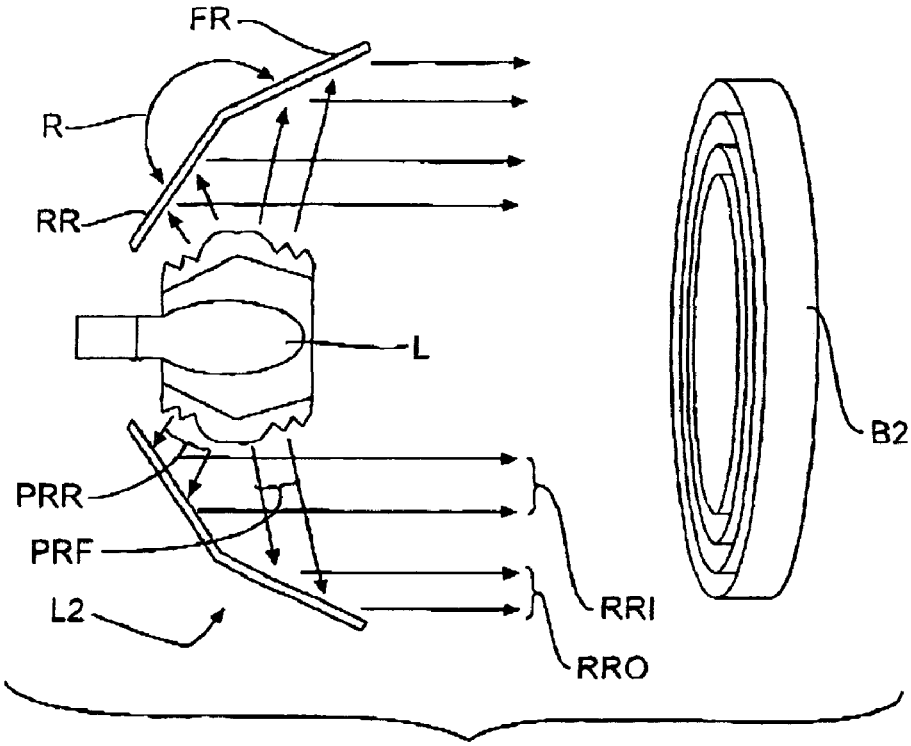

FIG. 8 and FIG. 8A illustrate two luminaire variations L and L2 that are designed to collect and project radially collimated light in the form of a cylindrical beam. The combined ring lens sections of ORLR and ORLF function in a similar manner to ORLU and ORLL of FIG. 5; in FIG. 8, projected beams PRR and PRF are reflected by conical reflector RR and FR respectively in substantially the same direction as concentric circles of rays RRI and RPO. Rectangular cell light baffle B1 and concentric ring baffle B2 can be used interchangeably with L1 or L2. These light baffles function to eliminate stray light emanating from the luminaires without loss of efficiency since the majority of light produced by lamp L is collimated by the optics illustrated.

Figure 9:
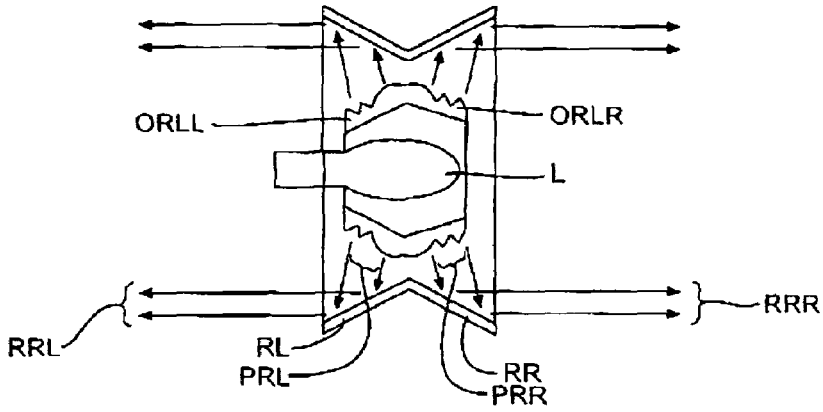
FIG. 9 is a schematic side view of a variation of the luminaires shown in FIGS. 8 and 8A, having reflector sections facing opposite directions.

FIG. 9 illustrates a variation of FIGS. 8 and 8A in that reflectors RL and RR receiving canted rays PRL and PRR respectively are reflected in opposite directions by conical reflectors RL and RR respectively. Although reflectors RR and FR of FIGS. 8, 8A, and 9 have been described as conical, they can be constructed with cross-sectionally curved surfaces and may have radial or axial fluting or V grooves.

Figure 10:
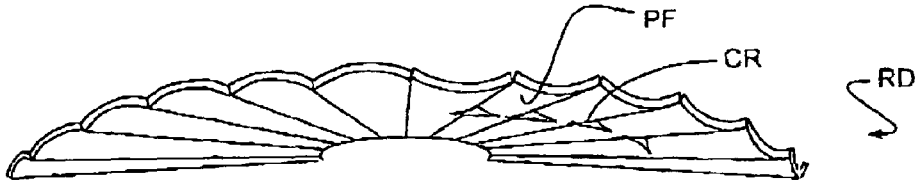
FIG. 10 is an isometric view of a disk comprised of varied reflector shapes.
Figure 10A:
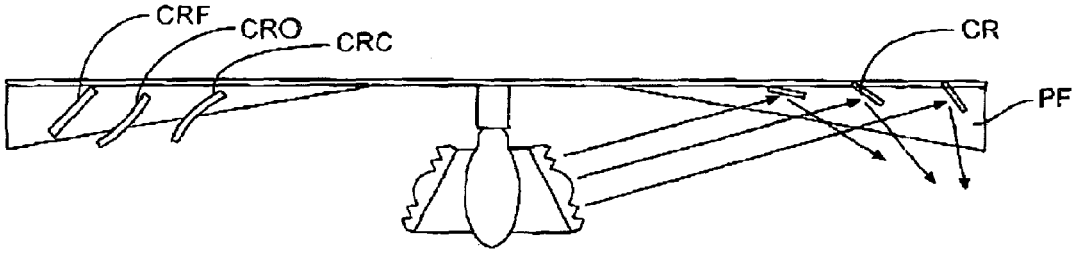
FIGS. 10A and 10B are schematic cross-sectional views of luminaires illustrating various constructions using the disk of FIG. 10 and showing their relationship to off-axis ring projections.

FIG. 10 is a 3-dimensional view of a reflector disk such as DR of FIG. 1 or IR of FIG. 5; in FIG. 10, positive radiating flutes PF are intercepted by a circular reflector CR. CR can have a reflective surface that is concave (CRC), convex (CRO), or flat (CRF) as shown in FIG. 10A. Curvature or flatness of flutes, rings or other optical features can be fabricated with film materials such as diffraction gratings where multiple embossed prismatic shapes, lines, etc. take the place of larger optical formations.

Figure 10B:
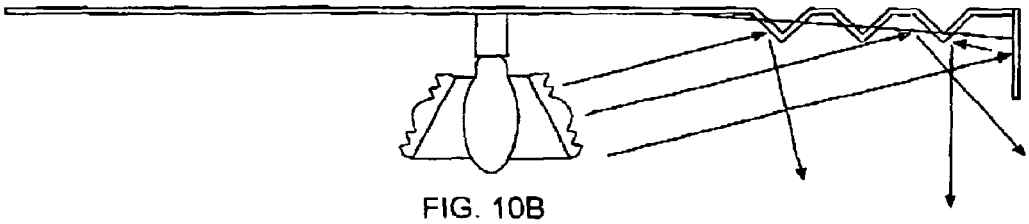

Similar configurations may be constructed from specular sheet material or injection molded with cross-sections such as those shown in FIGS. 10A and 10B. Radial reflector components PR and concentric reflector components CR are fabricated as a uniform structure.

Figure 11:
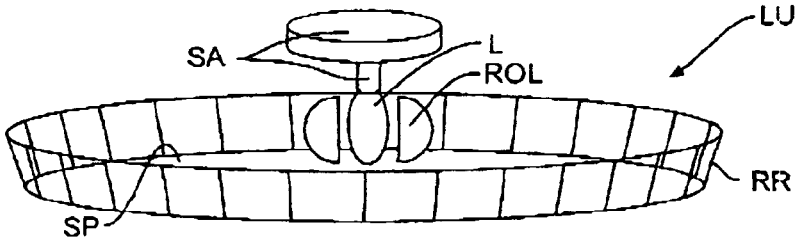
FIG. 11 is an isometric view of a luminaire, comprised of a lamp surrounded by a ring lens, further surrounded by a reflector ring.

FIG. 11 is a three-dimensional view of a luminaire containing lamp L, ring lens ROL, support disk SP (which may be substituted by rods, wires etc.), reflector ring RR and suspension assembly SA to hang the system from the ceiling if the luminaire were to be suspended.

Figure 12:
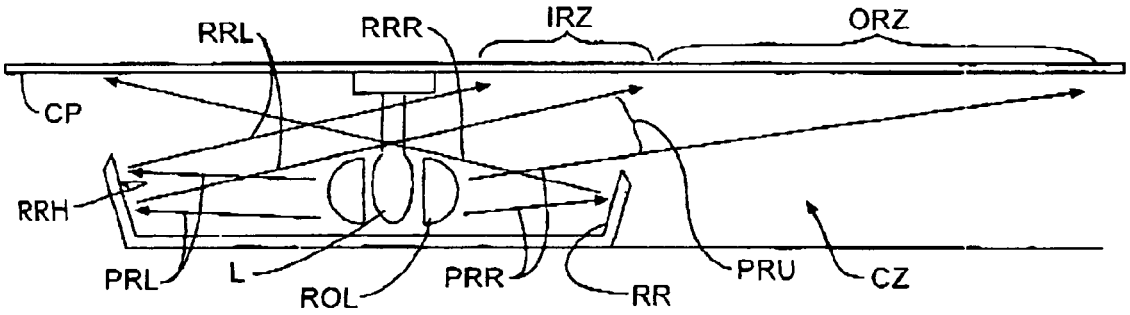
FIG. 12 is a schematic cross-sectional view of the luminaire shown in FIG. 11, illustrating its optical functions.

FIG. 12 is a cross-sectional view of FIG. 11 showing two possible functions of its optical system. Projected radial rays PRR emanating from ROL are partially intercepted and reflected by RR as rays RRR at an angle toward inner radial zone IRZ or outer radial zone ORZ. The direct (non-intercepted) portion of the PRR (PRU) travels to and strikes CP either within the radial zone close to the luminaire IRZ or the outer radial zone ORZ. In contrast to PRR being divided into reflected rays RRR and non-reflected rays PRU, rays PRL (the left side of FIG. 12) are completely intercepted and reflected by RRH toward and onto CP at IRZ or ORZ. It would be predetermined in the luminaire design as to the amount of light within direct and reflected rays and their angles of projection forming an evenly distributed light pattern on the ceiling plane. FIG. 12 further illustrates that RR, by intercepting at least a portion of PRR, creates light cut-off zone CZ.

Figure 12A:
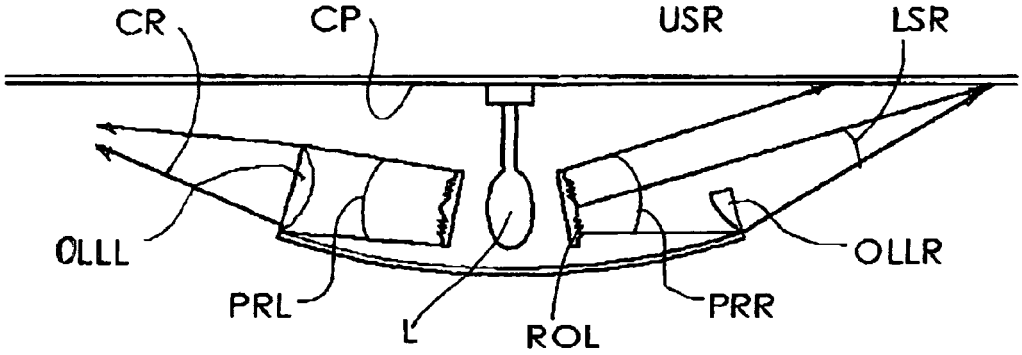
FIG. 12A is a variation of the luminaire shown in FIG. 12, illustrating the change from a reflector ring to a lens ring.

FIG. 12A is a cross-sectional view of an optical system showing a lamp L, a canted ring collimator ROL, and an outer ring lens shown in two configurations: ring lens OLLL, having a positive power, focuses projected rays PRL toward and onto ceiling plane CP; and ring lens OLLR, also having a positive power (and possibly being a circumferential segment of a ring lens), intercepts, focuses, and directs the lower portion of rays PRR onto CP—preferably on a circumferential area further from L than rays VSR. The powers of OLLL and OLLR determine the brightness and edge definition of the light projected on CP. OLLL and OLLR also provide visual cut-off from the brightness of ROL.

Figure 13:
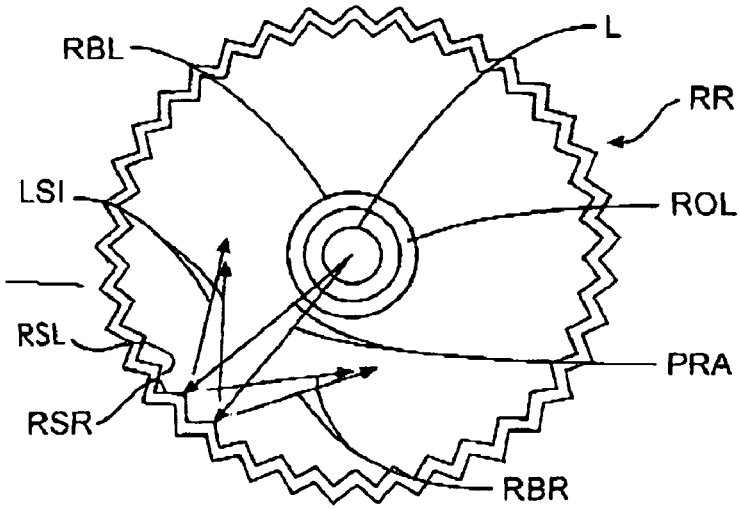
FIG. 13 is a plan view of the luminaire shown in FIG. 12, showing a variation of the reflector ring.
Figure 13A:
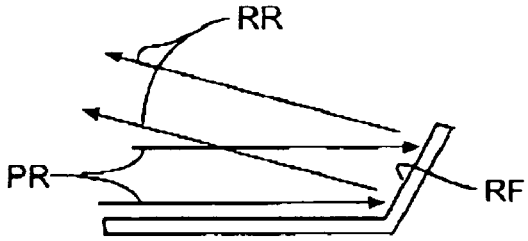
FIGS. 13A, 13B, and 13C are partial cross-sectional views showing alternatives to the reflector ring shown in FIG. 12.
Figure 13B:
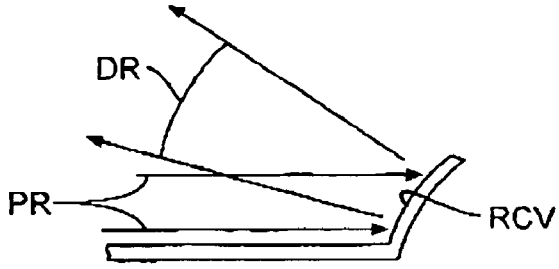
Figure 13C:
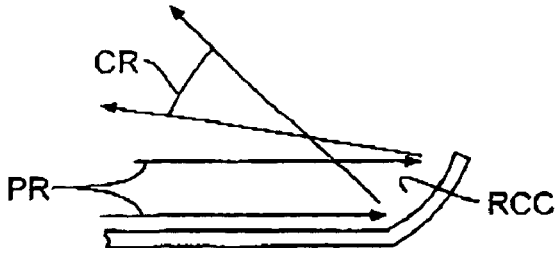

FIG. 13 is a top section view of FIG. 12 illustrating that RR may be comprised of angle segments typically RSL and RSR which divide radial beam segment typically PRA into reflected segments RBL and RBR respectively so that reflected rays are not obscured by SA (FIG. 11). FIG. 13A shows RR (FIGS. 11, 12, 13) having a sectionally flat surface RF reflecting PR as substantial parallel rays RR. FIG. 13B shows RR as having a convex surface RCV reflecting PR as diverging 3; beams DR. FIG. 13C shows RR having a concave surface RCL reflecting PR as converging then diverging beam CR. RR may have any compound curved, flat, sectional, or formed surface.

Figure 14:
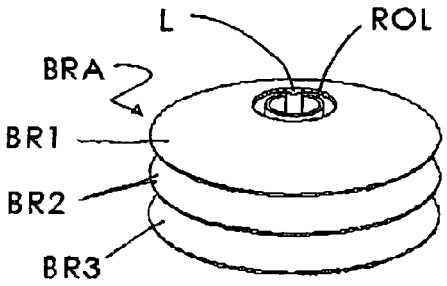
FIGS. 14 and 15 are a side view and schematic cross-sectional view, respectively, of a luminaire comprised of a lamp and an off-axis collimating ring surrounded by baffle assemblies.
Figure 15:
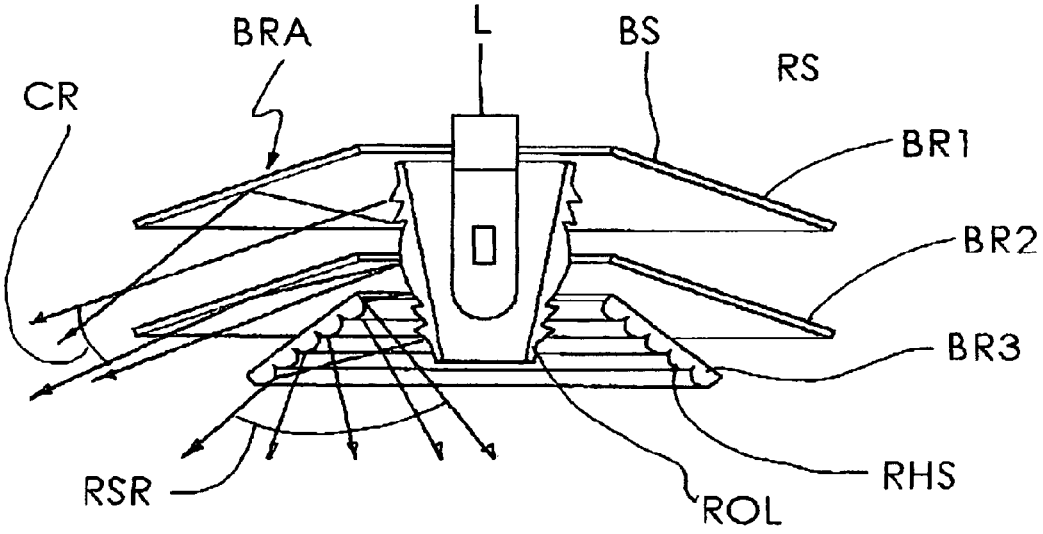

FIG. 14 a three-dimensional view and FIG. 15 is a section view: illustrates a baffle assembly BRA surrounding a ring lens ROL and lamp L in FIG. 15. Baffle rings BR1 and BR2 are essentially flat in section, non-reflective on top, and reflective below; and canted in a direction to allow a portion of partially collimated rays CR to pass directly through while reflecting the remaining rays. Ring BR3 (FIG. 15) is canted at an angle to reflect a portion of the intercepted rays at an angle different from those rays intercepted by BR1 and BR2. In addition, BR3 is shown to have a reflective surface. BR1, BR2 and BR3 may be stacked in any order. RHSS has convex bumps or convex depressions scattering intercepted rays from the lens and scattering them as rays RSR.

Figure 16:
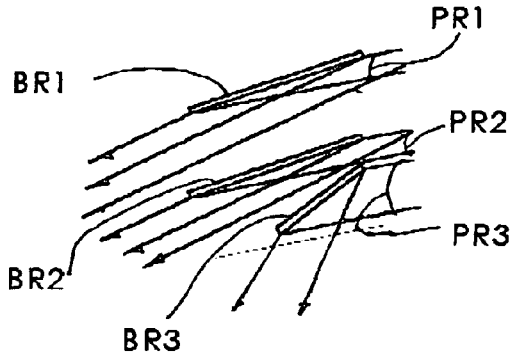
FIG. 16 is a partial cross-sectional view of a detail of a baffle assembly.

FIG. 16 is a section detail of a baffle assembly comprised of baffle rings BR1, BR2 and BR3 similar to those described in FIG. 14, although BR3 is shorter in width than BR1, BR2 having a smaller I.D. or O.D.

FIGS. 17, 18, 19, 20, 20A, 21, 22, and 23 represent single baffle ring constructions and shapes and their respective beam modification function. Baffle ring assemblies may be constructed to utilize any combination or number of baffle rings shown in these figures. The ratios of the different types of baffle rings to each other, mainly those that are canted at different angles to each other, those having differing reflecting depth (surface area) of each ring, and those with differing surface qualities (specular or diffuse), determine the resulting illumination pattern of the luminaire.

Figure 17:
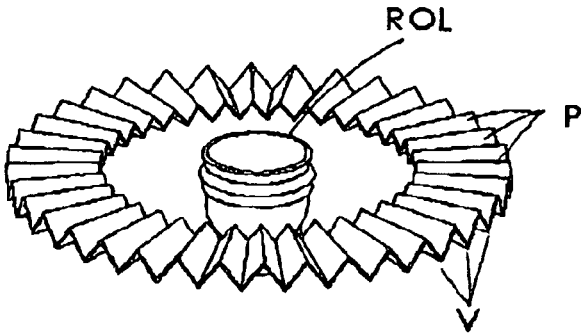
FIG. 17 is an isometric ivew of a ring lens surrounded by a baffle reflector ring.

FIG. 17 is a baffle ring comprised of V shaped waves. The peaks P and the valleys V of the waves can have an origin projected from a common point, or be parallel to each other, or be at irregular angles to each other; the relationships to the peaks and valleys determine the reflected pattern of rays from lens ROL.

Figure 18:
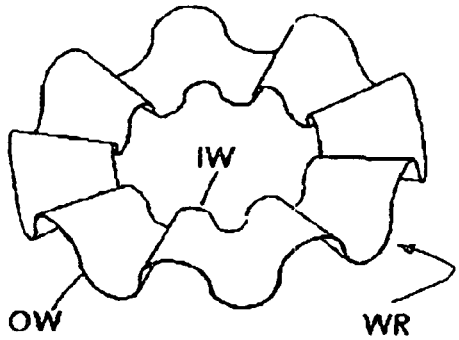
FIG. 18 is an isometric view of a baffle reflector ring.

FIG. 18 shows a wave reflector WR that may be in the form of a sine wave or may be of other waveforms in section. The wave geometry may vary in that the waveform on the inside diameter IW may be different than the waveform on the outside diameter OW.

Figure 19:
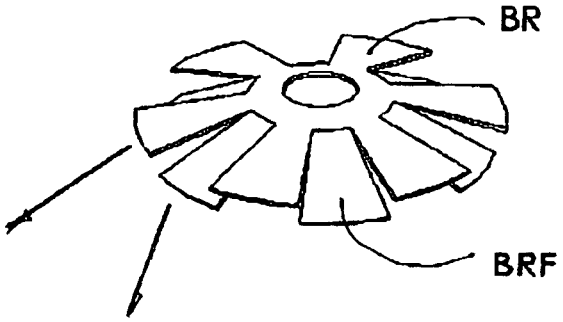
FIG. 19 is an isometric view of a baffle reflector ring with alternate variations in cant angle.

FIG. 19 illustrates a baffle ring BR which may be substantially flat or conical, having leaves BRF that lie on the outer diameter of BR and are bent at an incline to the plane of BR.

Figure 19A:
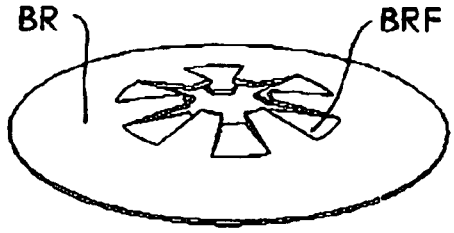
FIG. 19A is an isometric view of a variation of the baffle reflector ring of FIG. 19.

FIG. 19A is a variation of FIG. 19 showing leaves BRF being formed on the inside diameter of BR.

Figure 20:
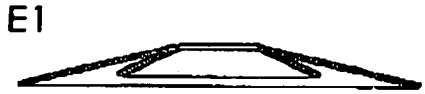
FIG. 20 is a schematic view illustrating the optical function of the structure shown in FIGS. 19 and 19A.
Figure 20:
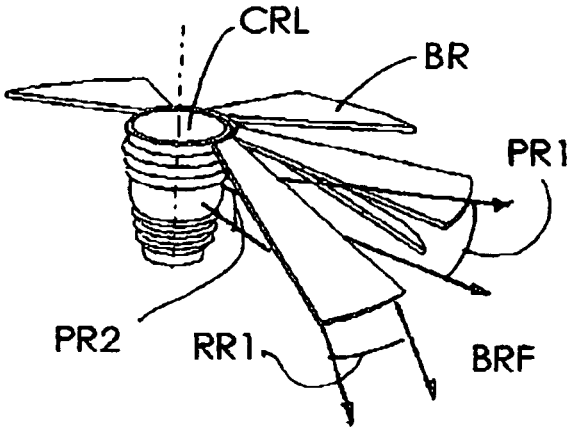

FIG. 20 is a 3-dimensional cross-sectional detail of FIG. 19, showing canted (off-axis) ring lens CRL projecting typical projected radial rays PR1 not being intercepted by BR while other typical rays PR2 are intercepted and reflected by BRF.

Figure 21:
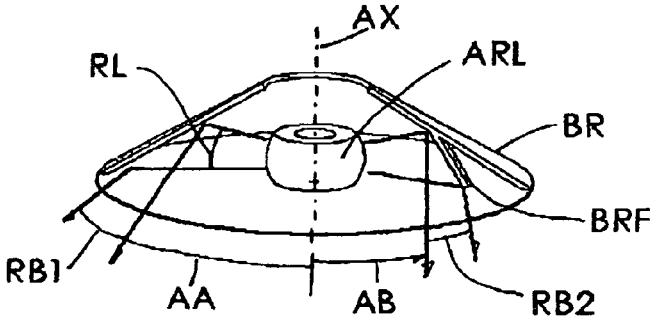
FIG. 21 is an isometic view showing the optical function of a ring lens surrounded by a reflector section.

FIG. 21 shows a variation in function to FIG. 20 in that an on-axis ring lens ORL has replaced the off-axis lens CRL of FIG. 20. This replacement has been done for ease of explanation and to illustrate that lenses that are not optically canted can substitute for the canted lenses for use with any of the above mentioned optical systems. ARL projects radial beam RL onto BR and is reflected away from BR at the angle AA from the central optical axis AX. RL also is intercepted and reflected by BRF at angle AX, which differs from angle AA.

Figure 22A:
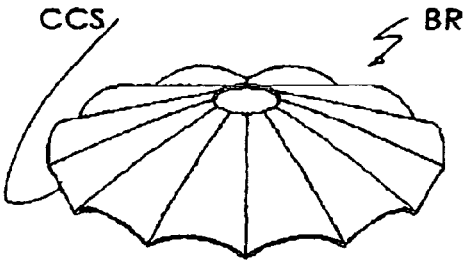
FIGS. 22, 22A and 23 are isometric views illustrating varied reflector ring shapes.
Figure 24A:
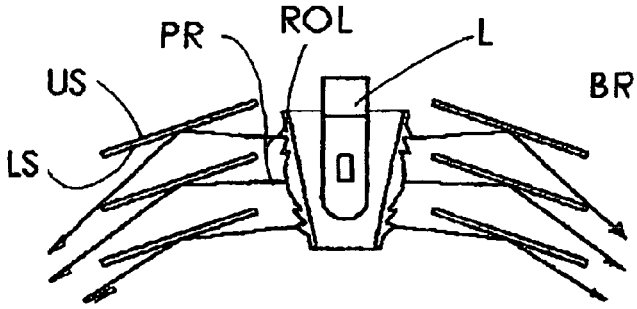
FIG. 24A is a schematic partial cross-sectional view of the luminaire of FIG. 24.
Figure 22:
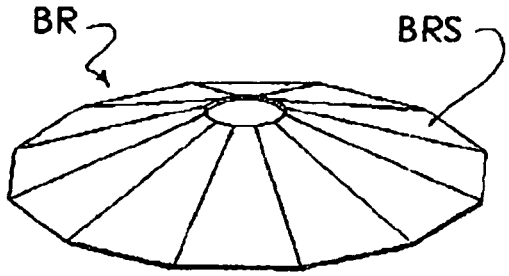

FIG. 22 illustrates a substantially conical baffle ring BR, comprised of flat sections BRS.

FIG. 22A illustrates a substantially conical baffle ring comprised of concave or convex sections CCS.

Figure 23:
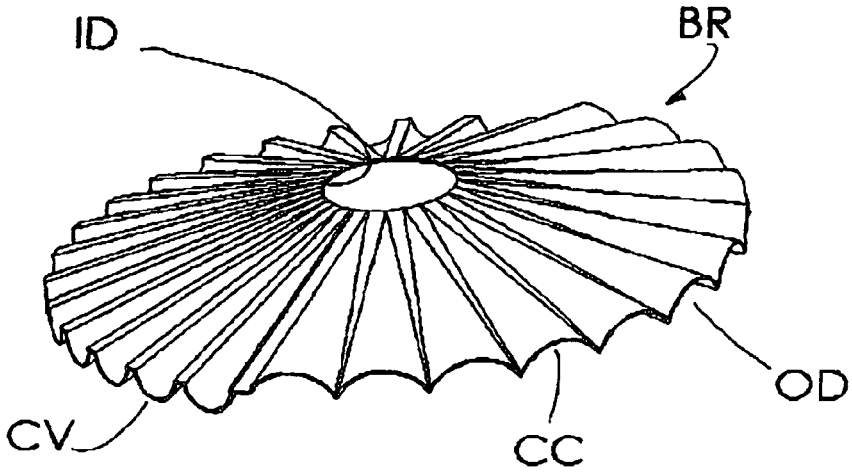

FIG. 23 illustrates a baffle ring BR where the inside diameter ID or the substantially conical shape is a simple circle, and the outside diameter OD is comprised of a combination of convex CV or concave CC arcs, or either/or convex CV or concave CC arcs, forming a series of conical forms radiating about BR.

Figure 24:
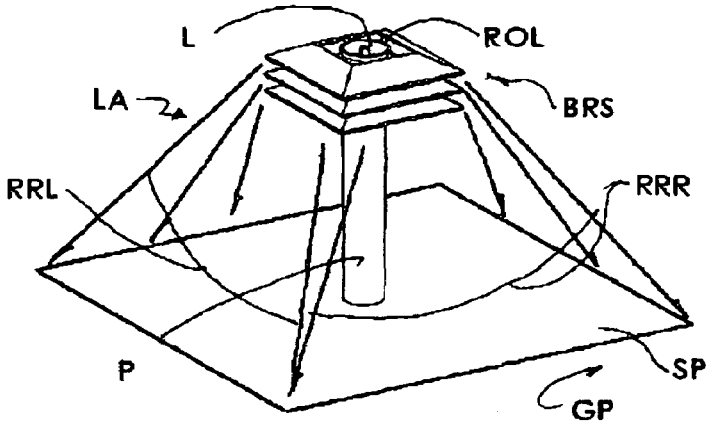
FIG. 24 is an isometric view which illustrates a pole-mounted luminaire and its lighting function.

FIG. 24 is a 3-dimensional illustration of a luminaire LA consisting of a lamp L surrounded by a collimating ring lens ROL further surrounded by a baffle reflector assembly BRS and pole S which mounts the above mentioned components to ground plane GP. The baffle reflector leaves BRL of BRS (shown in FIGS. 24 and 24A) form and intersect in plan, forming a polyhedron such as a rectangle or square; the sections BRL may be flat or curved as elaborated on in FIGS. 24B and 24C. The lower surface LS of BRL is specular or semi-specular while the upper surface US is non-reflective (one option being matte black).

Figure 24B:
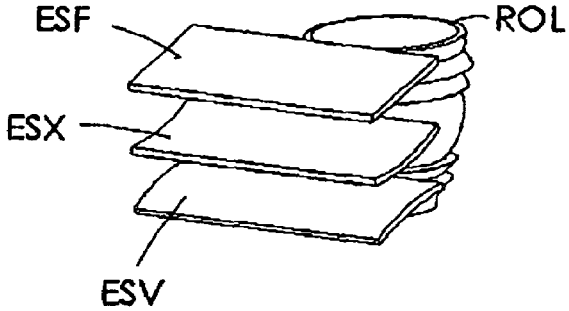
FIGS. 24B and 24C are isometric views illustrating variations of baffle assemblies.
Figure 24C:
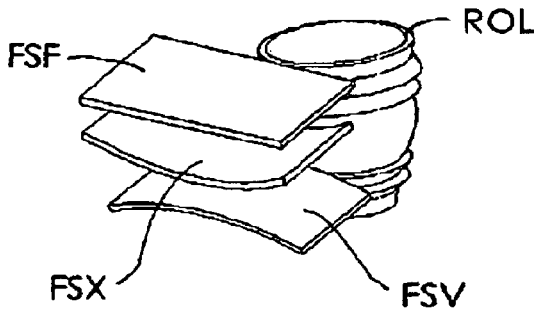

FIGS. 24B and 24C illustrate variations in baffle reflector BRL curvatures. FIG. 24B shows variations in the side edge section curvatures: ESF is flat (no curvature), ESX is convex, and ESV is concave. FIG. 24C shows possible variations of front edge curvatures: FSF is flat, FSX is convex, and FSV is concave. The choice of curvature used, whether used in combination or in assemblies of the same curvatures, or whether edge and face curvatures are combined to form specific ground patterns of illustrations SP (shown in FIG. 24), determines ground pattern shapes such as polyhedral patterns.

Figure 24E:
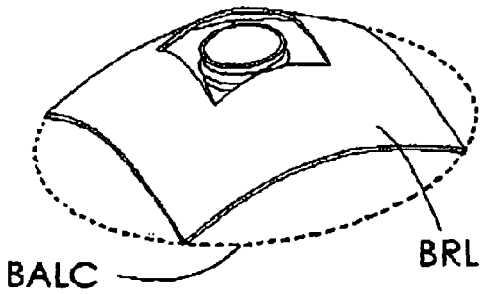
FIG. 24E is a schematic view illustrating a plan shape for a baffle assembly.
Figure 24D:
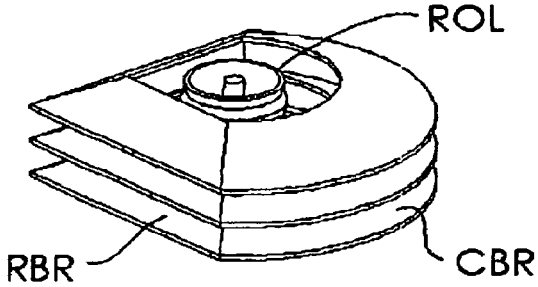
FIG. 24D is an isometric view of a baffle assembly having two sections.

FIG. 24D illustrates a baffle assembly surrounding a ring lens ROL. The baffle ring assembly has been divided into two sections: RBR and CBR. The resulting illumination pattern reflected by RBR would be substantially rectangular while light reflected by CBR would form a pattern that would be substantially circular.

FIG. 24E illustrates that the shape edges BRLC of baffle BRL (as viewed in the plan, from below or above), can be curved or straight or any other geometric shape.

Figure 25:
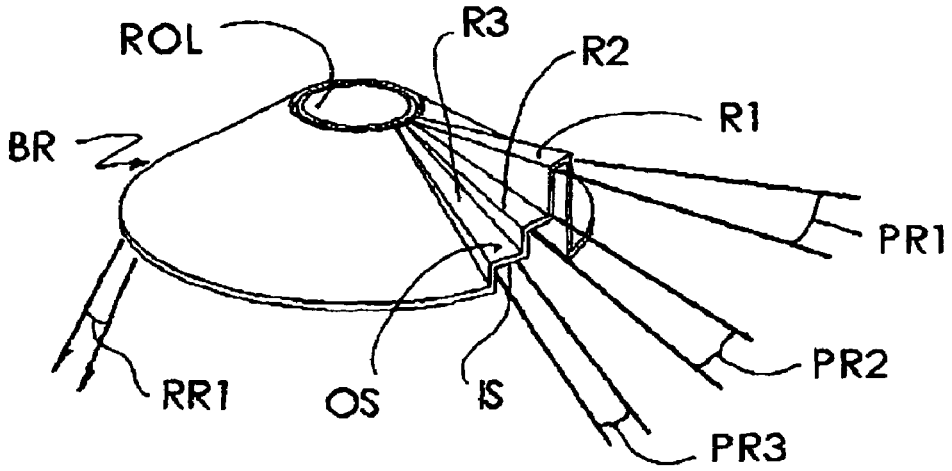
FIG. 25 is an isometric view illustrating a ring lens surrounded by a baffle reflector ring comprised of stepped changes in cant angle.

FIG. 25 is a three-dimensional illustration of a ring lens ROL surrounded by a single baffle ring BC. The outside surface OS of the baffle ring is non-reflective while the inside surface is specular or semi-reflective (some light distribution requirements may require reversing the surface qualities or having both IS and OS be specular, or a mix of both IS and OS be specular and non-specular). Baffle reflector ring BR is divided into radial sections R1, R2 and R3, which have reflective surfaces that are respectively at progressively increasing angles to the light ray projected by ROL, thus changing the angle of reflected light beams RR1, RR2 and RR3. Reflector segment R1 is canted at an angle equal to the projected rays PR and therefore does not intercept or change the angle of projected light beam PR. Such BR (JS: Should this be "PR"?) forms can be used to create specific patterns or surface illumination such as squares on (JS: or?) rectangles.

Figure 26:
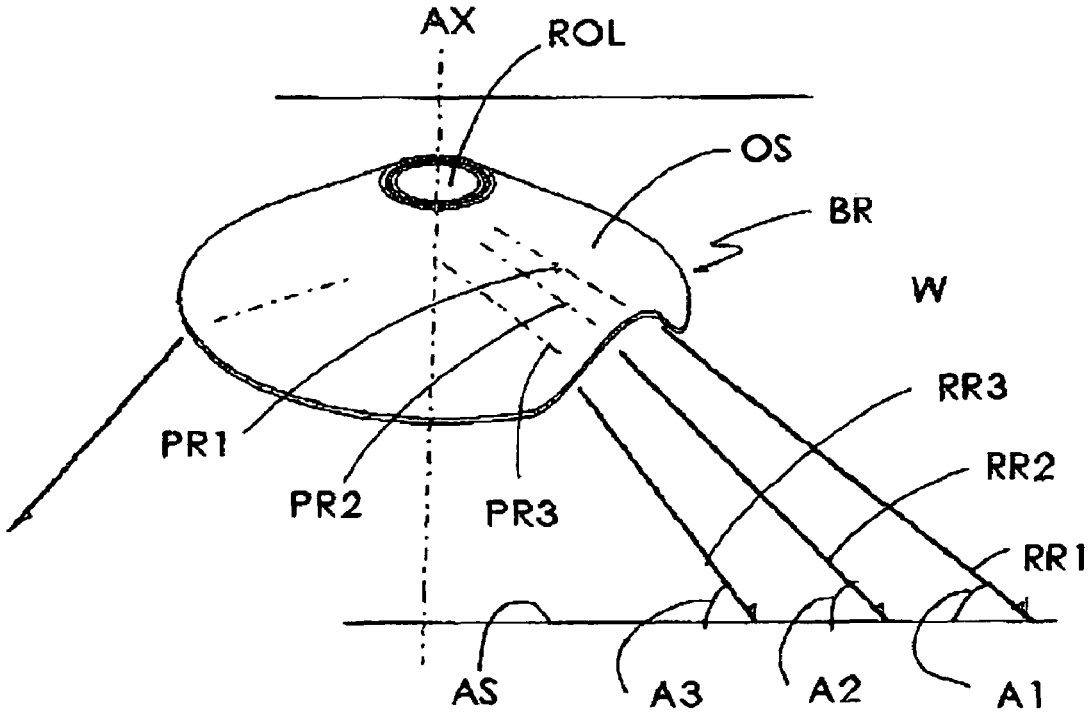
FIG. 26 is an isometric view illustrating a ring lens surrounded by a baffle reflector ring formed to have a wave in the cant angle.

FIG. 26 illustrates a baffle reflector ring BR surrounding an off-axis ring lens ROL. BR is shaped in the form of a wave (illustrated by angle BAO being greater than angle BAA) to reflect radially projected rays PR1, PR2 and PR3 as reflected rays RR1, RR2 and RR3 at varied inclines to central axis AX and architectural surface A3. These inclines are represented by angles A1, A2 and A3 respectively.

Figure 27:
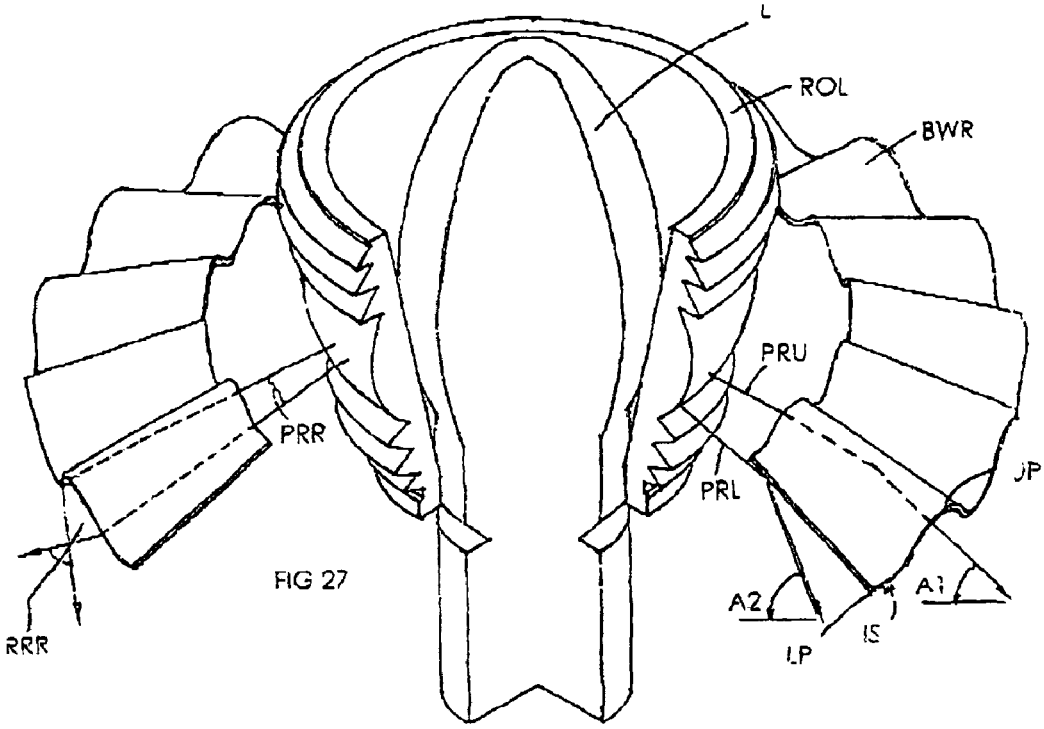
FIG. 27 is an isometric view illustrating a lamp surrounded by a ring lens further surrounded by a baffle reflector that is comprised of wave forms.

FIG. 27 is a three-dimensional view of an optical assembly having a ring lens ROL (surrounding lamp L) projecting a canted radial beam through and onto wave baffle ring's BWR inner surface IS. Upper ray PRU and lower ray PRL are reflected by the wave form UP and the bottom of the wave form LP, resulting respectively in A1 and A2. Angles A1 and A2 would be proportionate to the difference of angles at UP and LP. Rays PRR would also converge then diverge as rays RRR after striking the lower surface of BWR.

For graphic purposes the function of BWR has been divided into the left and right side of FIG. 27, although the functions shown happen simultaneously on each wave of BWR.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

The invention claimed is:

1. A lighting assembly comprising:

a. a quasi-point light source;

b. a ring collimating lens surrounding said source and having an axis;

c. at least one light-absorbing baffle ring surrounding the ring lens, the arrangement of the baffle rings allowing light rays projected by the lens to leave at acute radial angles and said ring lens being conical and being constructed and arranged to project rays at an acute angle to a perpendicular of the axis.

2. A lighting assembly as defined in claim 1 wherein at least one baffle ring is specular on its surfaces facing the light source.

3. A lighting assembly as defined in claim 2 wherein at least one specular surface has a texture.

4. A lighting assembly as defined in claim 2 wherein several baffle rings have specular surfaces, at least two of which have textures which are different from each other.

5. A lighting assembly as defined in claim 2 wherein at least one baffle ring is radially segmented for broadening or segmenting the light projected by the ring lens.

6. A lighting assembly as defined in claim 5 wherein the reflector ring includes flat segments canted to form a cone.

7. A lighting assembly as defined in claim 1 wherein there is a plurality of baffle rings which are a stacked series of light-absorbing baffle rings surrounding said ring lens, the spacing of the baffle rings allowing light rays projected by the lens to leave at acute radial angles.

8. A lighting assembly as defined in claim 1, wherein the baffle rings are arranged so that light does not pass from the light source directly to the eye of an observer.

9. A lighting assembly as defined in claim 1 wherein there are a series of reflector rings canted at angles to redirect substantially the entire radial beam projected by the ring lens.

10. A lighting assembly comprising:

a. a quasi-point light source having an optical axis;

b. a conical collimating ring at least partially surrounding said light source and having an imaginary radial projection, the ring constructed and arranged to project collimated rays along a path which is at an angle with respect to the optical axis and which is other than a right angle; and c. a reflective surface disposed inside the radial projection of the collimating ring to reflect a portion of the rays passing through the collimating ring.

11. A lighting assembly as defined in claim 10 wherein the reflective surface is conical.

12. A lighting assembly as defined in claim 10 wherein the reflective surface is at least partially (1) radially segmented into convex segments or (2) radially segmented into concave sections, or (3) divided in concentric concave surfaces.

13. A lighting assembly, comprising:

a. a quasi-point light source;

b. a ring lens surrounding said source and including two conical segments joined along a radial plane of light to provide two conically collimated beams canted at an angle to each other;

c. at least one light direction changing surface to at least partially intercept and reflect one conical beam.

14. A lighting assembly as defined in claim 13 further comprising an upper reflective plane, baffle rings surrounding both conical segments of the ring lens to cut off glare and brightness from the lens.

15. A lighting assembly as defined in claim 13 wherein there are reflective disks which intercept and reflect both canted collimated beams.

16. A lighting assembly as defined in claim 13 wherein the conical beam is projected directly by one ring lens segment and a conical beam is projected by the second ring lens segment and further reflected by a reflective plane to form a single conical beam.

17. A lighting assembly as defined in claim 16 wherein the single projected beam passes through a series of baffle rings.

18. A lighting assembly as defined in claim 13 wherein at least one of the conical radial beams is intercepted and refracted by a refractive ring.

19. A lighting assembly as defined in claim 13 wherein both conical radial beams are intercepted by individual reflective conical rings and reflected to form a single collimated beam.

20. A lighting assembly as defined in claim 13 wherein both conical beams are intercepted by individual reflective conical rings combined to form a unified reflective surface.

21. A lighting assembly as defined in claim 20 wherein the resulting unified beams pass through a baffle assembly.

22. A lighting assembly as defined in claim 13 wherein the light direction changing surface comprises two conical reflecting rings opposed to each other at 180 degrees, resulting in two collimated beams projecting at 180 degrees to each other.

23. A lighting assembly as defined in claim 13, wherein there are two light direction changing surfaces, one being an upper reflective surface to at least partially intercept and reflect one conical beam and the other being a lower refractive plane to at least partially refract the other conical beam.

24. A light assembly comprising:

a. a quasi-point light source having an optical axis;

b. a first ring lens surrounding said source and constructed and arranged for creating a conical collimated radial beam;

c. a second ring lens at least partially surrounding the first ring lens constructed and arranged to receive the conical beam and refocus the beam toward and onto an adjacent surface, the refocused beam being along a path which is at an angle with respect to the optical axis and which is other than a right angle.

25. A lighting assembly comprising:

a. a quasi-point light source;

b. a ring collimating lens surrounding said source;

c. at least one light-absorbing baffle ring surrounding said ring lens, the arrangement of the baffle rings allowing light rays projected by the lens to leave at acute radial angles said assembly having a central axis;

said ring being conical, the radial projection axis of which is other than a right angle to the central axis of the assembly; and said baffle ring arrangement being a stacked series that are canted, planar in section, and parallel to the radial projection axis of the ring lens.

26. A lighting assembly as defined in claim 25 wherein the spacing of the baffle ring arrangement allows light rays from the lens to leave at acute radial angles.

27. A lighting assembly as defined in claim 25 wherein the spacing of the canted baffle ring arrangement is constructed so that only collimated light is allowed through the baffle rings.

28. A lighting assembly as defined in claim 25 wherein a plurality of baffle rings have specular surfaces and at least one baffle ring is conical and canted at an angle acutely to the canted angle of the other baffles.

* * * * *